US010751741B2

(12) United States Patent
Santagiuliana

(10) Patent No.: US 10,751,741 B2
(45) Date of Patent: Aug. 25, 2020

(54) DISPENSING DEVICE FOR DISPENSING LIQUIDS OR FLUIDS

(71) Applicant: TAPLAST s.r.l., Dueville, Povolaro (IT)

(72) Inventor: Evans Santagiuliana, Vicenza (IT)

(73) Assignee: TAPLAST S.P.A. (IT)

( * ) Notice: Subject to any disclaimer, the term of this patent is extended or adjusted under 35 U.S.C. 154(b) by 0 days.

(21) Appl. No.: 16/467,114

(22) PCT Filed: Nov. 27, 2017

(86) PCT No.: PCT/IB2017/057406
§ 371 (c)(1),
(2) Date: Jun. 6, 2019

(87) PCT Pub. No.: WO2018/104821
PCT Pub. Date: Jun. 14, 2018

(65) Prior Publication Data

US 2019/0314841 A1 Oct. 17, 2019

(30) Foreign Application Priority Data

Dec. 6, 2016 (IT) ..... 102016000123591

(51) Int. Cl.
*B05B 11/00* (2006.01)
*B65D 83/30* (2006.01)

(52) U.S. Cl.
CPC ..... *B05B 11/3059* (2013.01); *B05B 11/0091* (2013.01); *B65D 83/303* (2013.01)

(58) Field of Classification Search
CPC ..... B05B 11/3059; B05B 11/0091; B05B 11/0094; B05B 11/3023; B05B 11/3047; B65D 83/303
(Continued)

(56) References Cited

U.S. PATENT DOCUMENTS 3,221,950 A * 12/1965 O'Donnell ..... B65D 83/303 222/402.11
3,874,562 A * 4/1975 Hazard ..... B05B 11/047 222/209
(Continued)

FOREIGN PATENT DOCUMENTS

| | | | |
|---|---|---|---|
| EP | 1116522 | A2 | 7/2001 |
| JP | 10-236503 | A | 9/1998 |
| WO | 01/91911 | A1 | 12/2001 |

OTHER PUBLICATIONS

International Search Report dated Feb. 16, 2018 issued in corresponding PCT/IB2017/057406 application (4 pages).
English Abstract of JPH 10-236503 A published Sep. 8, 1998.

*Primary Examiner* — Lien M Ngo
(74) *Attorney, Agent, or Firm* — McDonald Hopkins LLC

(57) ABSTRACT

A dispensing device dispenses a liquid held in a container. The device includes an engagement portion for the mutual engagement of the device and the container. Drawing and dispensing means draws the liquid from the container to dispense it. A main operating body operates the drawing and dispensing means through pressure exerted along a pressing direction. The main operating body moves with respect to the engagement portion, when subjected to pressure, between a rest position and an activating position. A dispensing nozzle is fixed to the main operating body and provided with a dispensing duct suited to dispense the liquid. The dispensing nozzle is switched from the main operating body, through a rotary movement, between a dispensing position and a non-dispensing position. Constraining means prevents the movement of the main operating body along the pressing direction when the dispensing nozzle is in the non-dispensing position.

8 Claims, 11 Drawing Sheets

(58) Field of Classification Search
USPC ..... 222/321.7, 321.8, 508, 517, 153.04, 222/153.13, 530
See application file for complete search history.

(56) References Cited

U.S. PATENT DOCUMENTS

| | | | | | |
|---|---|---|---|---|---|
| 3,907,174 | A * | 9/1975 | Steiman | B05B 11/3001 | 222/153.13 |
| 4,272,228 | A | 6/1981 | Kutik et al. | | |
| 4,819,832 | A * | 4/1989 | Lawson | B05B 11/0005 | 222/153.13 |
| 4,901,878 | A * | 2/1990 | Humphries | B65D 1/14 | 215/383 |
| 5,392,968 | A * | 2/1995 | Dark | B65D 47/066 | 222/528 |
| 5,791,518 | A | 8/1998 | Amann et al. | | |
| 5,890,628 | A * | 4/1999 | Simpson | B65D 51/1644 | 222/131 |
| 6,715,649 | B2 | 4/2004 | Santagiuliana | | |
| 8,616,419 | B2 * | 12/2013 | Slack | B65D 1/12 | 222/533 |
| 9,393,583 | B2 * | 7/2016 | Tu | B05B 1/267 | |
| 2003/0075567 | A1 | 4/2003 | Santagiuliana | | |
| 2010/0006606 | A1 * | 1/2010 | Lee | B05B 11/0094 | 222/383.1 |

* cited by examiner

DISPENSING DEVICE FOR DISPENSING LIQUIDS OR FLUIDS

TECHNICAL FIELD OF THE INVENTION

The present invention concerns the dispensing of fluids or liquids. In particular, the present invention concerns the dispensing of fluids or liquids such as, for example, detergents, soaps, creams, for example for body and hair care, for washing one's hands, etc. In greater detail, the present invention concerns a dispensing device suited to dispense fluids or liquids of the type described above. In even greater detail, the present invention concerns a dispensing device of the type suited to be coupled with a container suited to hold the fluid or liquid to be dispensed, for example suited to be fixed to the neck of a container in the shape of a bottle or a similar shape.

DESCRIPTION OF THE STATE OF THE ART

Dispensing devices for dispensing liquids or fluids, for example liquid or fluid soaps for personal care are known in the art and widely marketed and used, said devices being suited, in fact, to allow liquids or fluids held in a container to be dispensed. Said devices generally comprise engagement means (for example, a threaded ring) suited to allow them to be applied or fixed to a container (for example, to the neck of a bottle-shaped container), drawing and dispensing means suited to draw the liquid or fluid from the container and to successively dispense it towards the outside, as well as operating means suited to operate the drawing and dispensing means, as well as, finally, a nozzle or spout through which the liquid or fluid is actually dispensed.

With the dispensing device applied to the container, for example, as mentioned above, screwed to the neck of the container, the drawing pipe of the drawing and dispensing means is at least partially immersed in the liquid or fluid to be dispensed, while the operating means and the dispensing nozzle are positioned outside the container itself. Exerting a pressure on the operating means, for example with the palm of a hand, makes the fluid or liquid flow upwards along the drawing means and allows it to be dispensed towards the outside through the dispensing nozzle.

In the most common and simple dispensing means, the dispensing nozzle, rigidly fixed to the operating means or even made in a single piece with the operating means, projects from the operating means and thus represents a hindrance which considerably complicates the handling of the device, both when it is handled individually and when it is handled together with the container (when it is applied to the container itself).

For example, a projecting dispensing nozzle makes the packaging operations considerably difficult. Furthermore, a projecting nozzle is a critical part, as it is likely to be damaged or even broken, both during the packaging operations and successively during transport, shipment, or handling in general.

In the attempt to overcome, at least partially, the drawbacks summed up above, dispensing devices have been recently proposed which are provided with a dispensing nozzle that can be switched from a non-dispensing position to a use or dispensing position, wherein in the non-dispensing position the dispensing nozzle occupies a minimum space or in any case less space than in the dispensing position. For example, devices have been proposed in which, in the dispensing position, the dispensing nozzle extends along a direction that is substantially perpendicular to the direction of extension of the drawing pipe (which corresponds to a direction substantially parallel to the plane where the container rests), while in the non-dispensing position the dispensing nozzle extends along a direction that is substantially parallel to the drawing pipe (and thus substantially along a vertical with respect to the plane where the container rests).

However, the dispensing devices with switching dispensing nozzle are not without drawbacks or disadvantages, either.

For example, a first drawback or inconvenience derives from the risk of undesired leakages of fluid or liquid in the case where the operating means that operate the drawing and dispensing means are activated, on purpose or inadvertently, when the dispensing nozzle is in the non-dispensing position.

A further drawback is related to the instability of the dispensing nozzle when it is in the non-dispensing position and to the fact that it can be moved, which makes it difficult to handle, for example during the packaging operations, and even to the risk of the nozzle being undesirably switched to its dispensing position.

Therefore, it is one object of the present invention to overcome the drawbacks mentioned above and observed in the solutions known in the art.

In particular, the objects of the present invention can be summed up as follows.

It is a first object of the present invention to provide a dispensing device suited to dispense fluids or liquids of the type with switching dispensing nozzle which makes it possible to prevent fluid or liquid leakages when the nozzle is in its non-dispensing position.

Among the objects of the present invention there is also the object to provide a dispensing device for fluids or liquids of the type with switching dispensing nozzle which makes the nozzle as stable as possible when it is in its non-dispensing position.

Dispensing devices according to the prior art are known from documents EP 1 116 522 A2, WO 01/91911 A1, U.S. Pat. Nos. 3,221,950, 4,272,228, JP H10236503 and U.S. Pat. No. 3,907,174.

SUMMARY OF THE PRESENT INVENTION

The present invention originates from the general consideration according to which the drawbacks observed in the devices made according to the known art can be overcome or at least minimized by conveniently shaping the dispensing nozzle in such a way as to fix it in a stable manner in its non-dispensing position.

According to a first aspect of the present invention, the subject of the same is a dispensing device suited to dispense a liquid or a fluid held in a container, said device comprising an engagement portion thanks to which said device and said container can be mutually engaged with each other, drawing and dispensing means suited to draw said fluid or liquid from said container and to respectively dispense it, a main operating body suited to operate said drawing and dispensing means through pressure exerted along a pressing direction, said main operating body being movable with respect to said engagement portion, when subjected to said pressure, between a rest position and an activating position for the operation of said drawing and dispensing means, and a dispensing nozzle fixed to said main operating body and provided with a dispensing duct for dispensing said fluid or liquid, wherein said dispensing nozzle can be switched with respect to said main operating body, through a rotary movement, from a dispensing position in which said dispensing duct is in communication with the inside of said main operating body and a non-dispensing position, wherein the device comprises constraining means suited to prevent the movement of said main operating body with respect to said engagement portion along said pressing direction when said dispensing nozzle is in the non-dispensing position.

According to a preferred embodiment, the constraining means comprise a first counteracting element associated with the dispensing nozzle and a second counteracting element associated with the engagement portion.

Preferably, the first counteracting element comprises a projecting element associated with the dispensing nozzle or a housing seat associated with the dispensing nozzle.

Preferably, the second counteracting element comprises a projecting element associated with the engagement portion or a housing seat associated with the engagement portion or a counteracting portion of an edge of the engagement portion.

In a preferred embodiment, the device furthermore comprises snap-on connection means suited to carry out a snap-on connection between the first counteracting element and the second counteracting element.

According to a preferred embodiment, the first counteracting element comprises a tab which projects from the dispensing nozzle.

According to a preferred embodiment, the second counteracting element comprises a tab which projects from the engagement portion.

Preferably, said projecting tab is at least partially elastic.

In a preferred embodiment, the projecting element of the first counteracting element and/or of the second counteracting element comprises a reference portion which protrudes from the projecting element and is suited to become engaged with a surface of the second counteracting element and/or of the first counteracting element when the dispensing nozzle is in the non-dispensing position.

According to a preferred embodiment, the engagement portion comprises at least one recessed seat suited to at least partially accommodate an end portion of the first counteracting element.

Preferably, the main operating body comprises an operating cover and the engagement portion comprises a threaded metal ring suited to accommodate the operating cover, said operating cover being suited to slide with respect to the threaded metal ring, preferably to slide inside the threaded metal ring, between the rest position and the activating position and vice versa.

According to a preferred embodiment, the device comprises elastic return means suited to bring the main operating body back to the rest position from the activating position.

The subject of the present invention includes also a system for dispensing a fluid or a liquid, said system comprising a container suited to hold said fluid or liquid and a dispensing device made according to one or more of the variant embodiments summed up above and/or described below.

BRIEF DESCRIPTION OF THE DRAWINGS

Further advantages, objects and characteristics, as well as further embodiments of the present invention, are defined in the claims and are illustrated in the following description, with reference to the attached drawings; in the drawings, corresponding and/or equivalent characteristics and/or component parts of the present invention are identified by the same reference numbers. In particular, in the figures:

DETAILED DESCRIPTION OF THE PRESENT INVENTION

Figure 1:
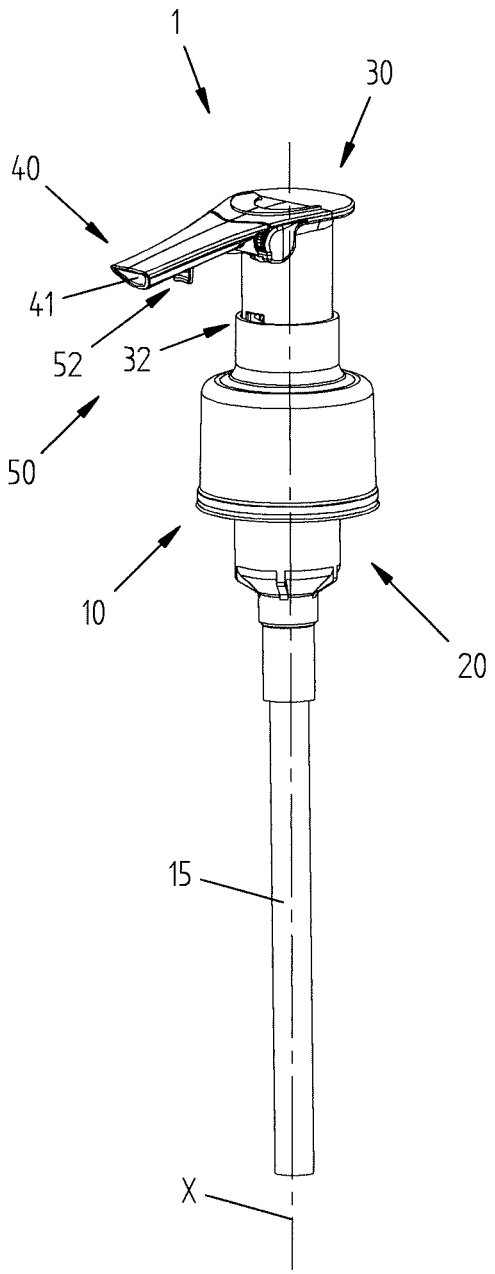
FIG. 1 shows an axonometric view of a dispensing device made according to an embodiment of the present invention, with the dispensing nozzle in the dispensing position.

Even though the present invention is described below with reference to its embodiments illustrated in the drawings, the present invention is not limited to the embodiments illustrated in the drawings and described in detail here below. On the contrary, the scope of the present invention covers all those variants of the embodiments illustrated in the drawings and described in detail here below which appear to be obvious to the expert in the art.

Figure 2:
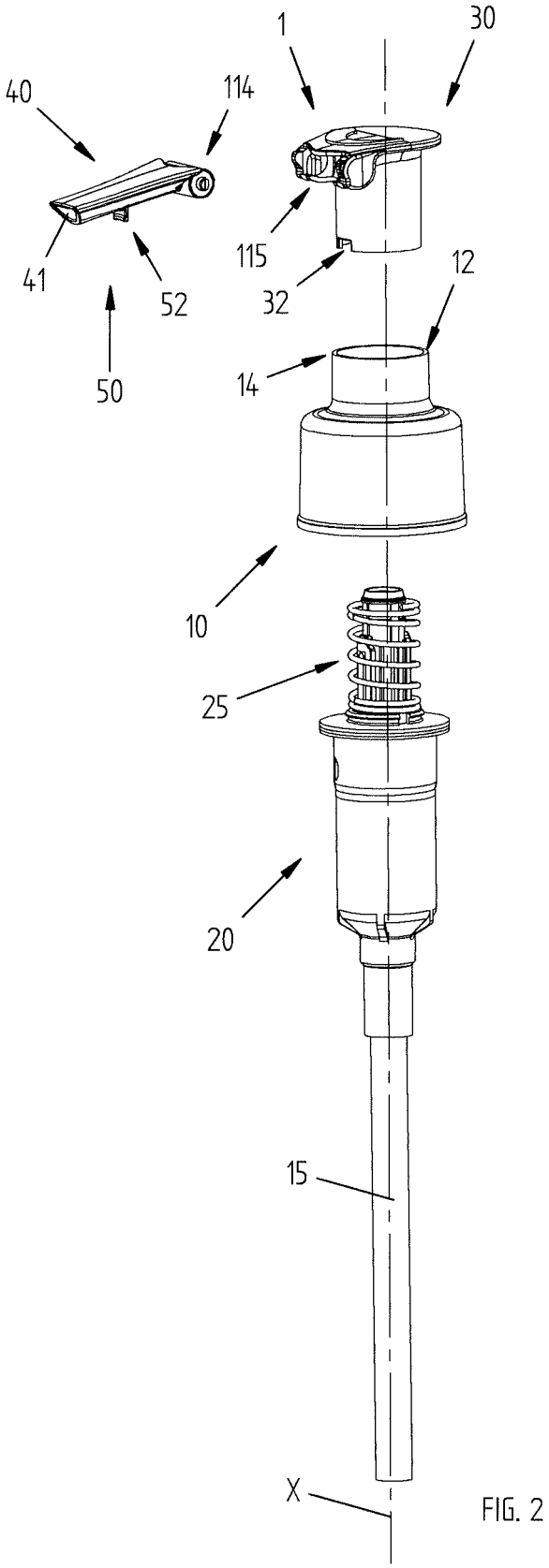
FIG. 2 shows an exploded view of FIG. 1.
Figure 5:
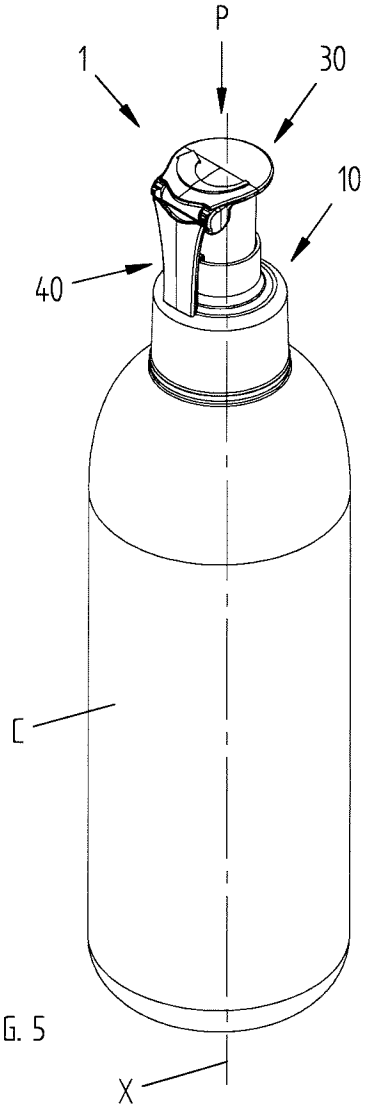
FIG. 5 shows the system of FIG. 3 with the dispensing device with the dispensing nozzle in the non-dispensing position.

FIGS. 1 and 2 show the dispensing device made according to a first preferred embodiment of the invention and identified by the reference numeral 1.

In the other figures and with regard to the other preferred embodiments described below, the dispensing device according to the invention is shown as a part of a dispensing system comprising also a container C, to which it is applied.

The dispensing device 1 substantially comprises an engagement portion 10, for example a threaded metal ring, through which the device 1 can be fixed to the container C, preferably screwed to the neck of the container C holding the fluid or liquid to be dispensed, drawing and dispensing means 20, as well as a main operating body 30, or operating cap 30, and finally a dispensing nozzle 40 suited to dispense the fluid or liquid towards the outside.

The parts that make up the dispensing device 1 are preferably made of a plastic material, for example through a thermoplastic moulding process.

Figure 4:
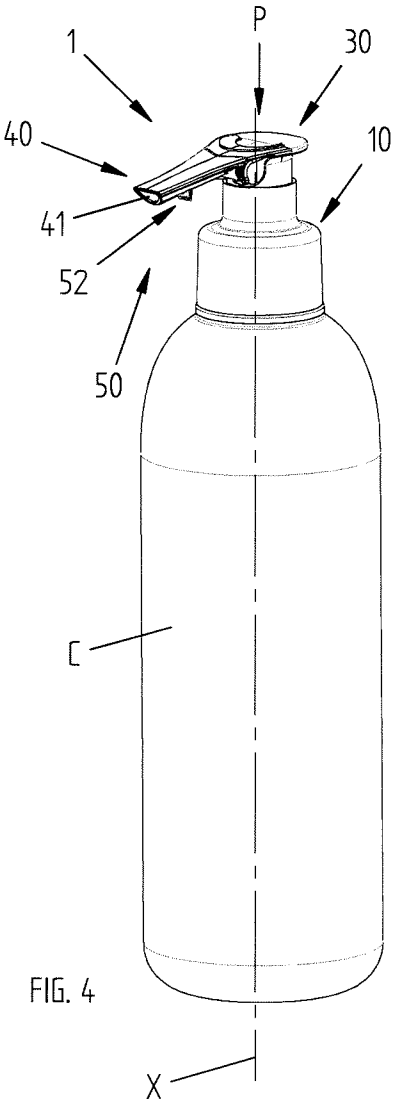
FIG. 4 shows the system of FIG. 3 with the dispensing device activated for the dispensing operation.
Figure 3:
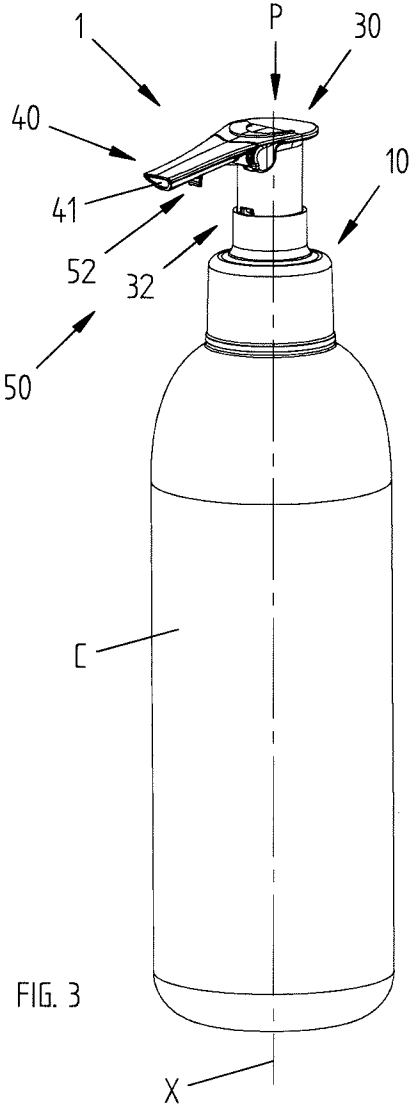
FIG. 3 shows a system in which the dispensing device of FIG. 1 is applied to a container in a first operating position.
Figure 6:
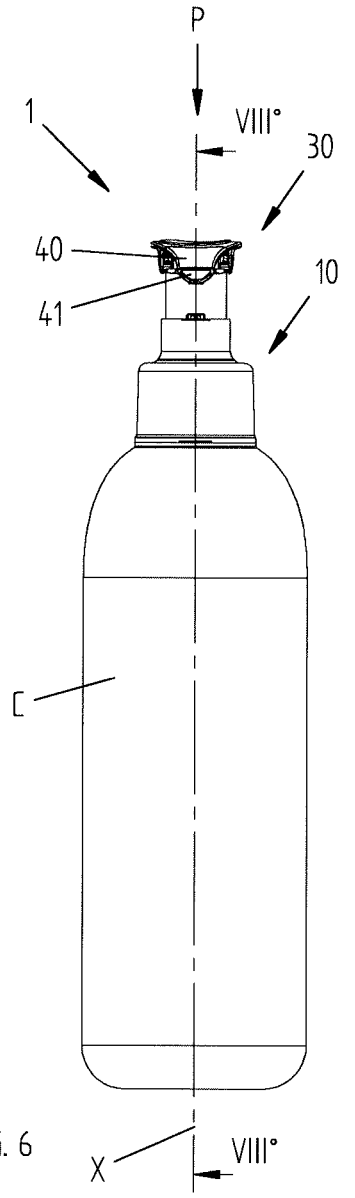
FIG. 6 shows a side view of the dispensing device of FIG. 3.
Figure 7:
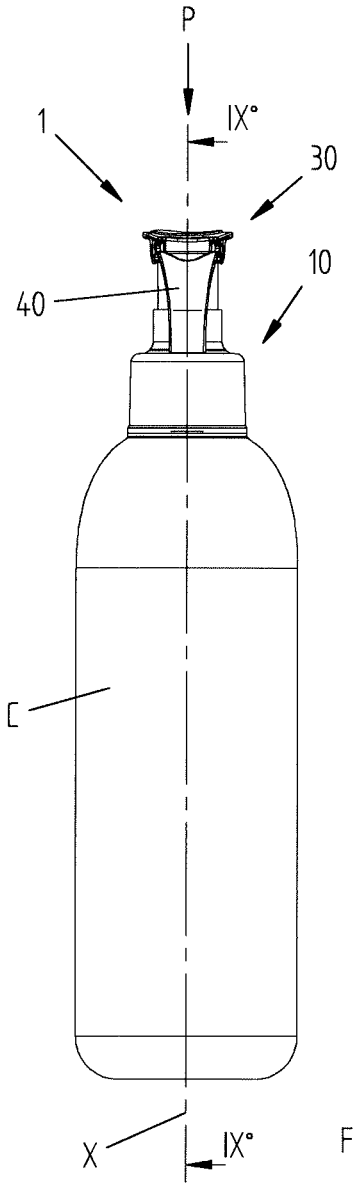
FIG. 7 shows a side view of the dispensing device of FIG. 5 with the dispensing nozzle in the non-dispensing position.

Pressing the operating cap 30, for example with the palm of a hand along a pressing direction P, as shown in FIG. 4, makes the fluid or liquid flow upwards along the suction pipe 15 (at least partially immersed in the fluid or liquid) of the drawing and dispensing means 20, and thus along the same means 20, and results in the fluid or liquid being dispensed through the cap 30 towards the outside, in particular through the dispensing duct 41 of the nozzle 40.

While the operating cap 30 is pressed along the pressing direction P, the same cap 30 slides inside the engagement portion 10 along a main sliding direction X substantially parallel to the pressing direction P, so as to operate said drawing and dispensing means 20, as explained above.

After the dispensing operation, elastic return means 25, preferably constituted by a helical spring, allow the cap 30 to be brought back to its initial position, or rest position, ready for a new dispensing cycle.

The engagement portion 10 has a substantially tubular shape, so that it can accommodate the cap 30 during its sliding movement, as explained above. The engagement portion 10 preferably comprises an edge 12 which delimits the upper part of the engagement portion 10.

The operating modes of the drawing and dispensing means 20, in particular the mechanisms through which the fluid or liquid flows upwards through the means 20 and successively flows out through the duct 41 of the nozzle 40, are not necessarily included in the objects of the present invention, therefore a detailed description of the same is omitted for the sake of brevity.

Figure 8:
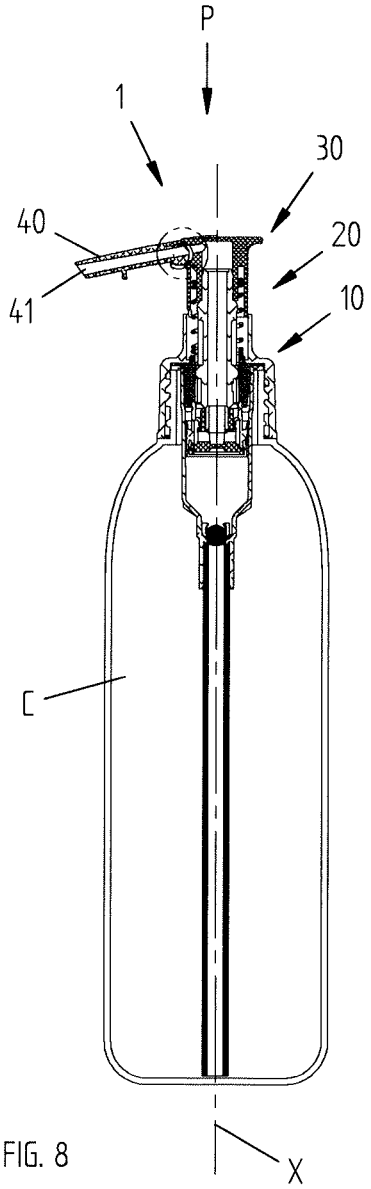
FIG. 8 shows a sectional view of the system of FIG. 6 according to section plane VIII-VIII.
Figure 8A:
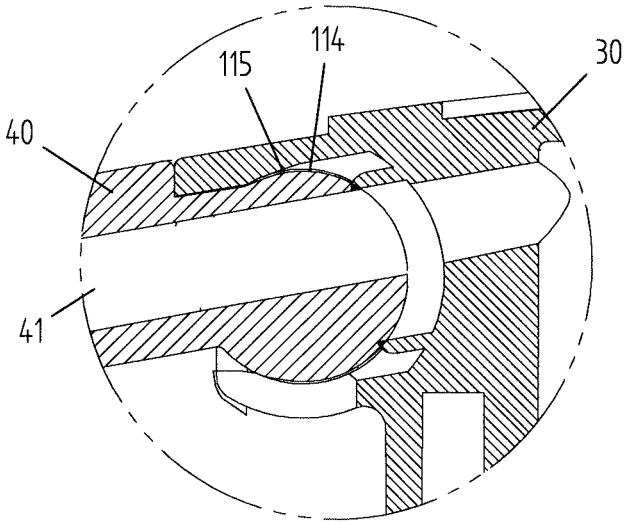
FIG. 8A shows an enlarged detail of FIG. 8.
Figure 9:
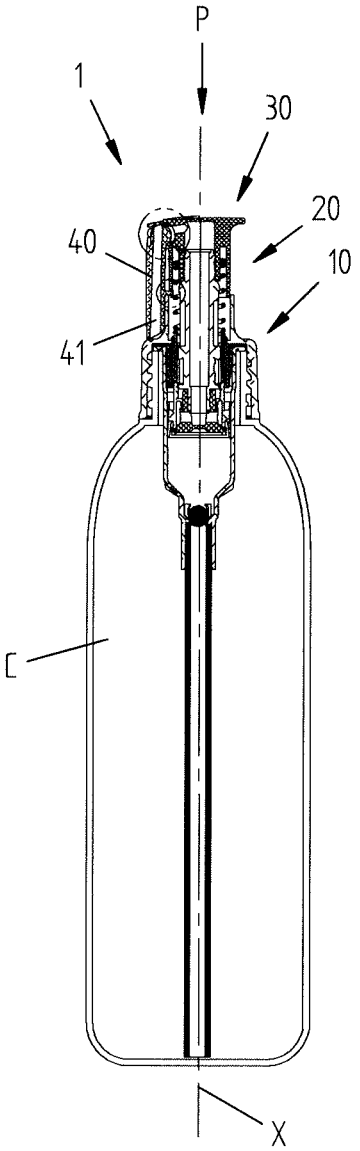
FIG. 9 shows a sectional view of the system of FIG. 7 according to the section plane IX-IX.
Figure 9A:
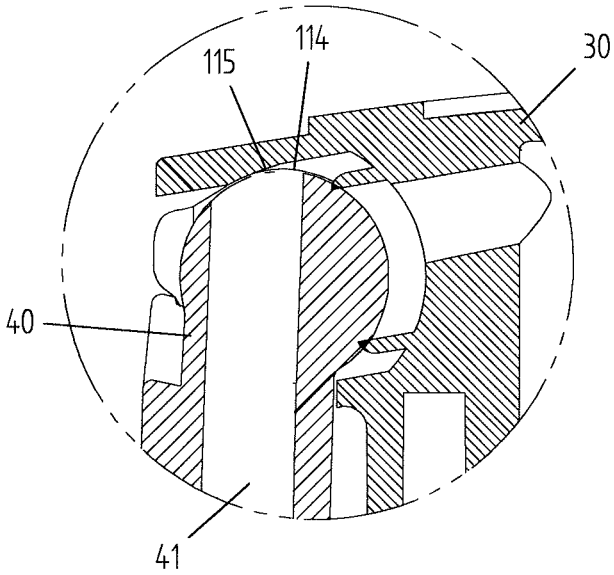
FIG. 9A shows an enlarged detail of FIG. 9.
Figure 11:
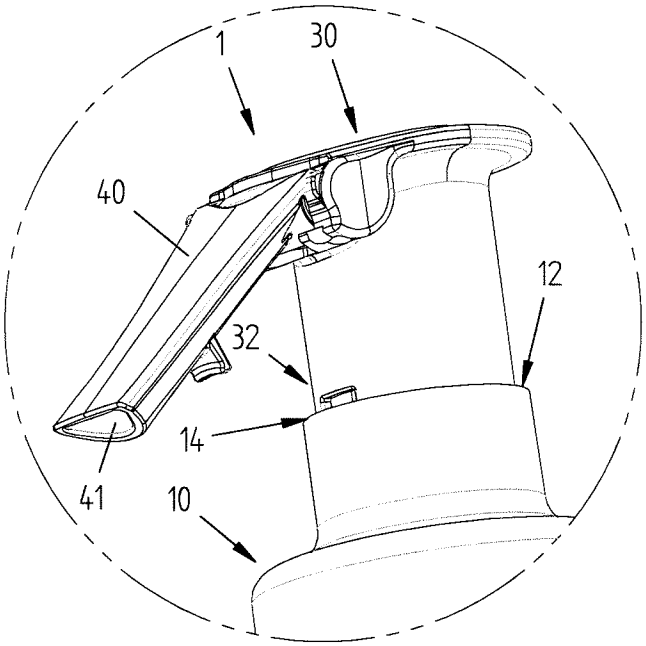
FIG. 11 shows the detail of the system of FIG. 10 with the dispensing nozzle in an intermediate position between the dispensing position and a non-dispensing position.
Figure 10:
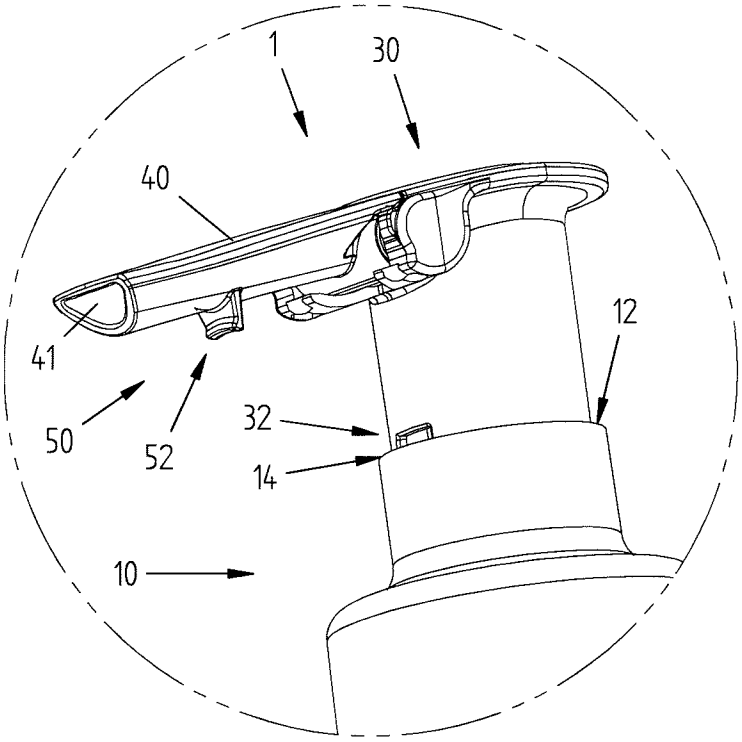
FIG. 10 shows an axonometric view of a detail of the system of FIG. 3 with the dispensing nozzle in the dispensing position.

According to an aspect of the present invention, the nozzle 40 is preferably of the type that can be switched, in particular rotated, between a dispensing position, represented for example in FIGS. 3, 6, 8 and 10, and a non-dispensing position, represented for example in FIGS. 5, 7, 9 and 12. In the dispensing position the dispensing duct 41 is in communication with the inside of the operating cap 30 (see, in particular, FIG. 8A), while, on the contrary, in the non-dispensing position (FIG. 9A) the dispensing duct 41 is not in communication with the inside of the cap 30, and the nozzle 40 closes the cap 30, thus interrupting any communication between the space inside the cap 30 (and thus inside the device 1) and the outside.

According to the methods adopted for use and operation of the device 1, substantially the nozzle 40 is first switched from the non-dispensing position (FIG. 5) to the dispensing position (FIG. 3), successively the cap 30 is pressed (once or several times, according to known methods) and the fluid or liquid is dispensed (FIG. 4) and finally the nozzle 40 is switched again from the dispensing position to the non-dispensing position, if required.

Preferably, the nozzle 40 comprises a constraining portion 114 housed in a housing or constraint seat 115 having a corresponding shape and defined by the operating cap 30. The shape of the constraining portion 114 and of the matching seat 115 can be selected according to the needs and/or circumstances; for example, a constraining portion 114 in a substantially cylindrical or even substantially spherical shape can be provided, wherein the shape of the seat 115 will match the shape of the constraining portion 114.

According to a preferred aspect of the present invention, the device 1 comprises constraining means 50 suited to prevent any mutual movement of the operating cap 30 and the engagement portion 10 when the dispensing nozzle 40 is arranged in the non-dispensing position.

The constraining means 50 preferably comprise a first counteracting element 52 associated with the dispensing nozzle 40 and a second counteracting element 14 associated with the engagement portion 10.

In the first preferred embodiment carried out according to the present invention, as illustrated in particular in Figures from 10 to 12A, the first counteracting element comprises a projecting element 52 that protrudes from the dispensing nozzle 40 and the second counteracting element comprises a counteracting portion 14 of the upper edge 12 of the engagement portion 10.

Figure 12:
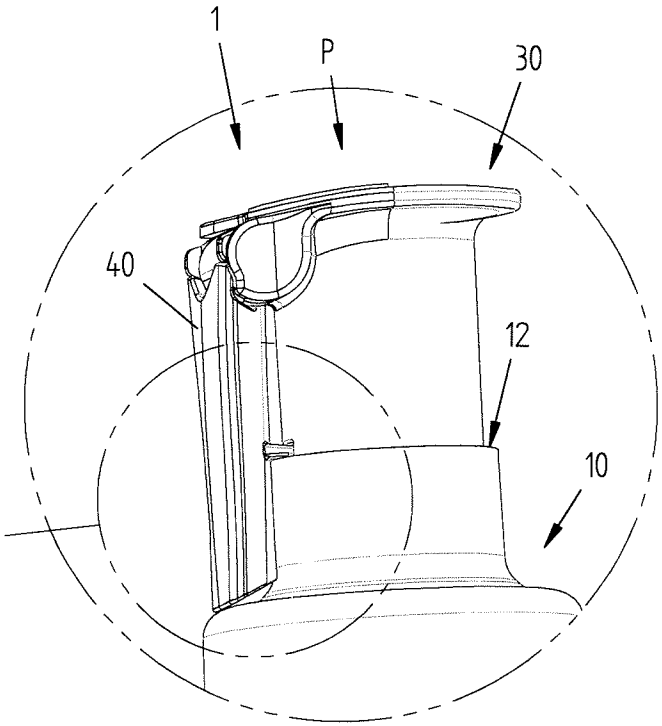
FIG. 12 shows a detail of the system of FIG. 5 with the dispensing nozzle in a non-dispensing position.
Figure 12A:
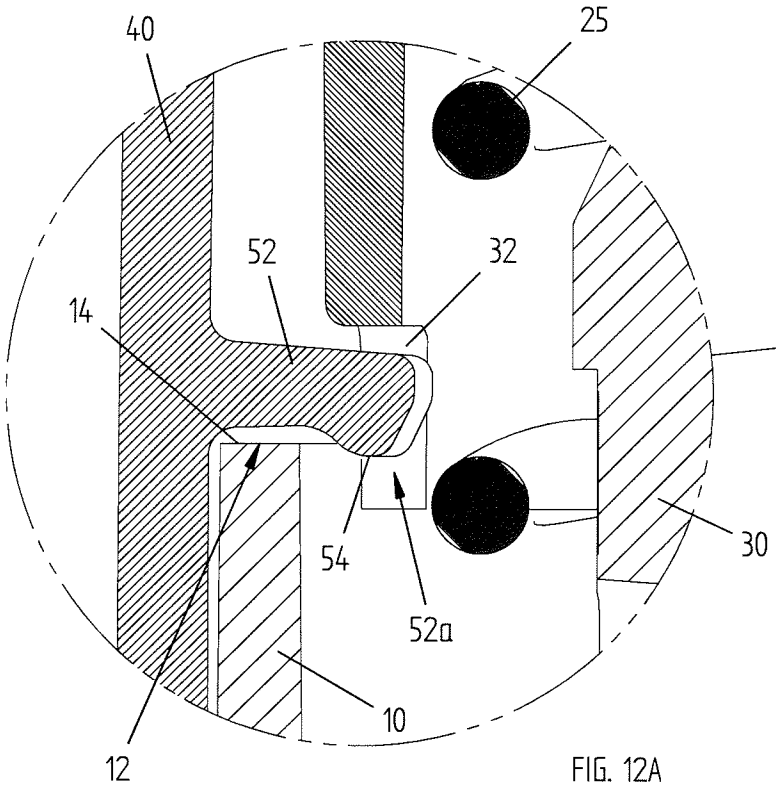
FIG. 12A shows a sectional view of a detail of FIG. 12.

When the dispensing nozzle 40 is arranged in the non-dispensing position, the projecting element 52 abuts against the counteracting portion 14 of the upper edge 12 of the engagement portion 10, as shown in particular in FIG. 12A.

The mutual position of the projecting element 52 and the counteracting portion 14 preferably prevents the movement of the operating cap 30 with respect to the engagement portion 10 in the case where the operating cap 30 is pressed along the pressing direction P.

Advantageously, if the operating cap 30 is pressed, on purpose or inadvertently, along the pressing direction P when the dispensing nozzle 40 is in its non-dispensing position, undesired outflows of fluid or liquid from the container C are avoided.

The projecting element 52 is preferably constituted by a tab that projects from the dispensing nozzle 40 in the direction of the engagement portion 10 when the same dispensing nozzle 40 is in its non-dispensing position.

Preferably, the operating cap 30 comprises a housing seat 32 suited to house the free end 52*a* of the tab 52.

Advantageously, the housing seat 32 allows the dispensing nozzle 40 to be positioned in such a way that it is as adherent as possible to the engagement portion 10 when the same dispensing nozzle 40 is in its non-dispensing position, with evident advantages in terms of limitation of the overall dimensions of the device 1 itself.

Figure 14:
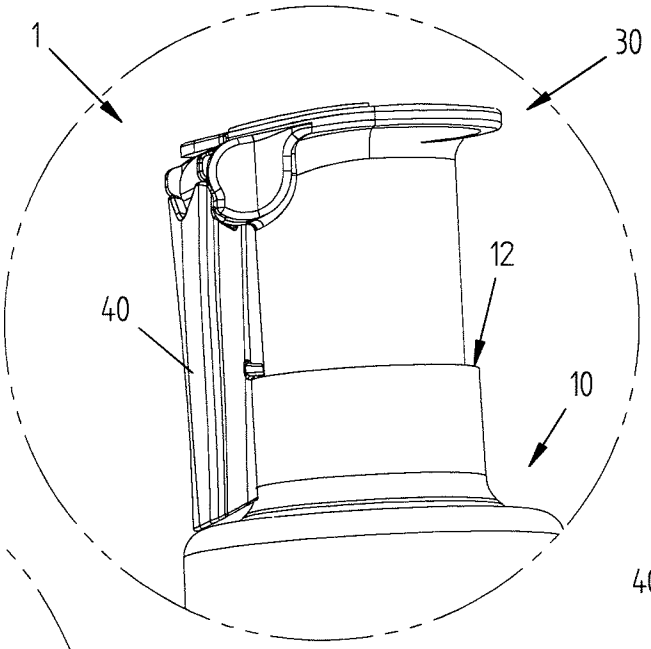
FIG. 14 shows the detail of the system of FIG. 13 with the dispensing nozzle in a non-dispensing position.
Figure 14A:
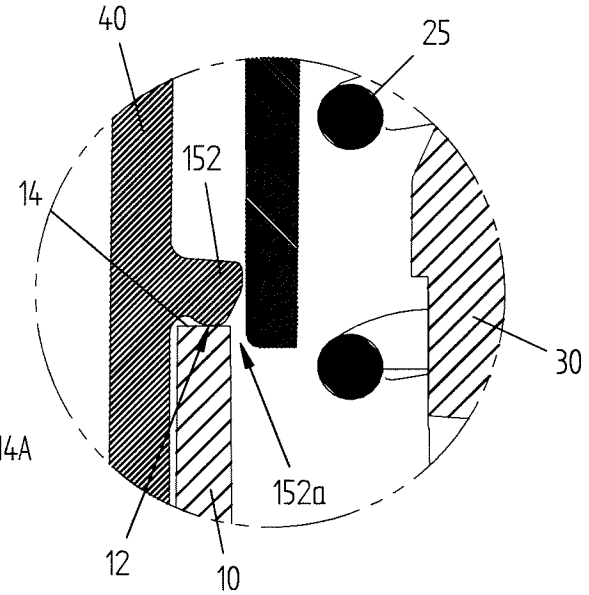
FIG. 14A shows a sectional view of a detail of FIG. 14.
Figure 13:
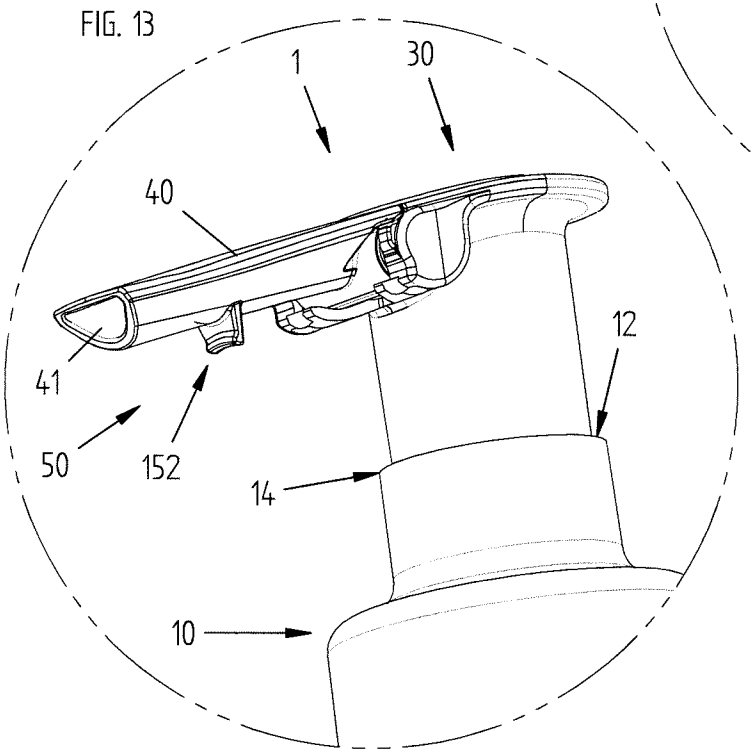
FIG. 13 shows a variant embodiment of FIG. 10.

In variant embodiments, as illustrated for example in FIGS. 13, 14 and 14A, said housing seat may be absent.

According to the preferred embodiment illustrated herein, the projecting element 52 preferably comprises also a reference portion 54 that protrudes from the projecting element 52 in the direction of the counteracting portion 14 of the upper edge 12 of the engagement portion 10 when the dispensing nozzle 40 is in its non-dispensing position.

The reference portion 54 allows the snap-on connection of the projecting element 52 with the upper edge 12 of the engagement portion 10.

The snap-on connection of the projecting element 52 is preferably obtained thanks to the elasticity of the projecting element 52, such elasticity being due to the material with which the projecting element 52 is made. The projecting element 52 is preferably made of a plastic material. The projecting element 52 and the dispensing nozzle 40 are preferably obtained in a single piece, for example through a thermoplastic moulding process.

The elasticity of the projecting element 52 allows the reference portion 54 to overlap the counteracting portion 14 of the upper edge 12 of the engagement portion 10 when the nozzle 40 is brought/rotated to the non-dispensing position by exerting a sufficiently high force, and the projecting element 52 to be successively maintained in the locked position.

Analogously, the elasticity of the projecting element 52 allows the reference portion 54 to overlap the counteracting portion 14 of the upper edge 12 of the engagement portion 10 when the nozzle 40 is brought/rotated to the dispensing position only if a sufficiently high force is applied.

Advantageously, the snap-on connection of the projecting element 52 further guarantees that the dispensing nozzle 40 is maintained in its non-dispensing position in a stable manner, avoiding undesired outflows of fluid or liquid from the container C.

Advantageously, the snap-on connection of the projecting element 52 to the upper edge 12 of the engagement portion 10 furthermore prevents any movement of the dispensing nozzle 40 towards the dispensing position.

In a preferred variant embodiment, not illustrated herein, the snap-on connection may be obtained between the dispensing nozzle and the operating cap, for example the tab may snap in a corresponding slot made in the operating cap.

FIGS. 13, 14 and 14A show a preferred variant embodiment of the invention, as already explained above.

Said variant embodiment differs from the embodiment previously illustrated and described with reference to Figures from 1 to 12A in that the engagement portion 10 has no housing seat for the projecting element 152.

Furthermore, preferably, the projecting element 152 is shorter than the projecting element 52 previously described and its free end 152*a* preferably abuts on the counteracting portion 14 of the upper edge 12 of the engagement portion 10.

The projecting element 152 is preferably made of a plastic material and is preferably made in a single piece with the dispensing nozzle 40.

Advantageously, if the operating cap 30 is pressed, on purpose or inadvertently, along the pressing direction P when the dispensing nozzle 40 is in its non-dispensing position, undesired outflows of fluid or liquid from the container C are avoided.

Figure 16:
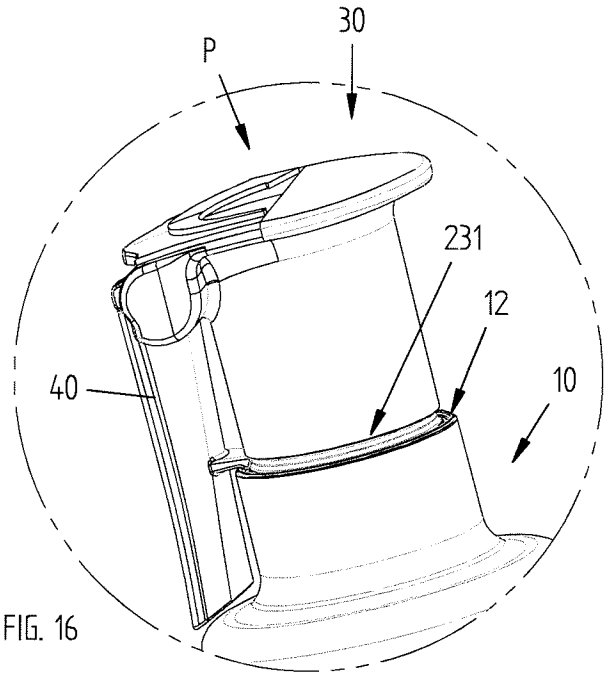
FIG. 16 shows the detail of the system of FIG. 15 with the dispensing nozzle in a non-dispensing position.
Figure 16A:
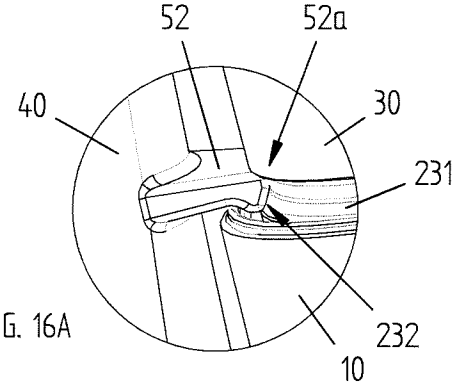
FIG. 16A shows an enlarged detail of FIG. 16.
Figure 15:
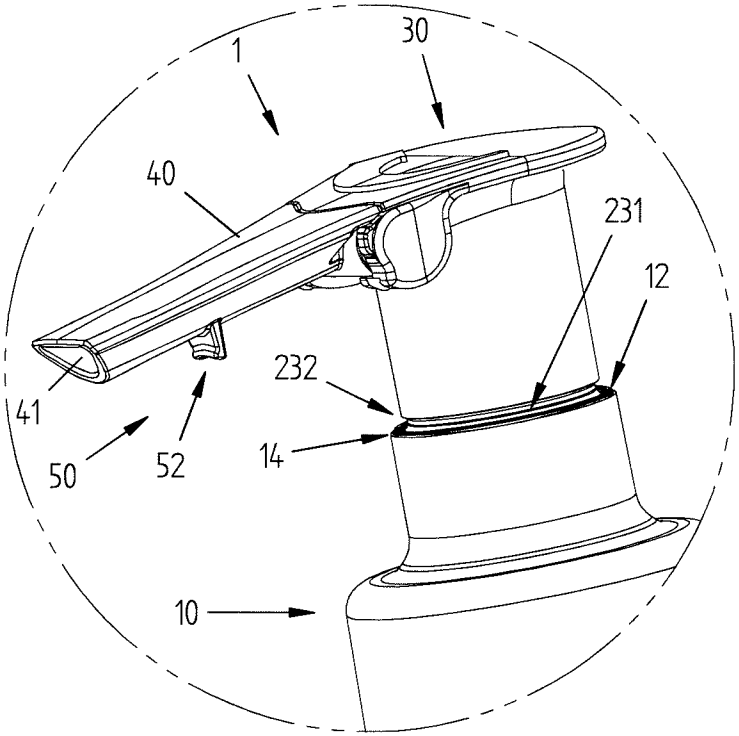
FIG. 15 shows a variant embodiment of FIG. 10.

FIGS. 15, 16 and 16A show a preferred variant embodiment of the invention, which differs from the embodiment previously illustrated above and described with reference to Figures from 1 to 12A in that the housing seat 232 of the engagement portion 10 which houses the end 52*a* of the projecting element 52 is constituted by a portion of an annular recess 231 that is located on the entire circumference of the engagement portion 10.

Advantageously, when the nozzle 40 is brought/rotated to the non-dispensing position, the end 52*a* of the projecting element 52 will be certainly accommodated in the housing seat 232, since the latter is present on the entire circumference, independently of the mutual position of the operating cap 30 and the dispensing nozzle 40 with respect to the engagement portion 10.

This solution makes it possible to obtain all the advantages mentioned with reference to the previous embodiments.

Figure 18:
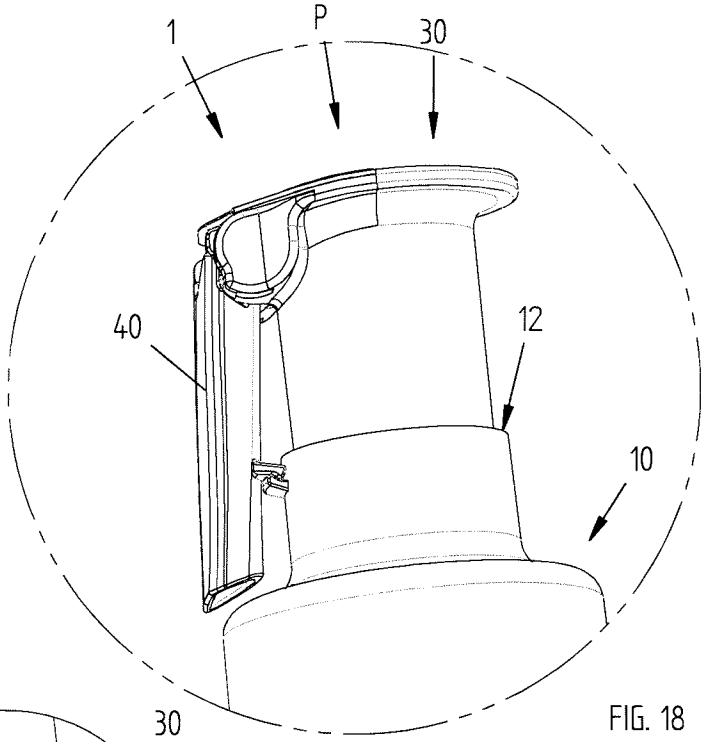
FIG. 18 shows the detail of the system of FIG. 17 with the dispensing nozzle in a non-dispensing position.
Figure 18A:
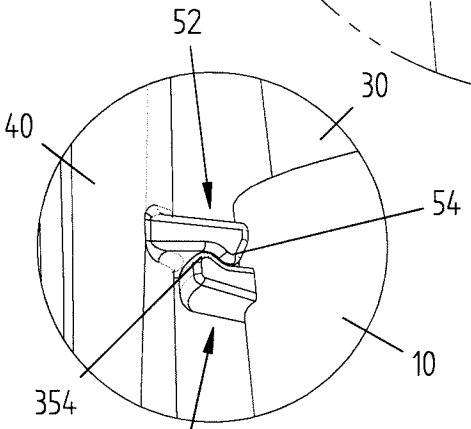
FIG. 18A shows an enlarged detail of FIG. 18.
Figure 17:
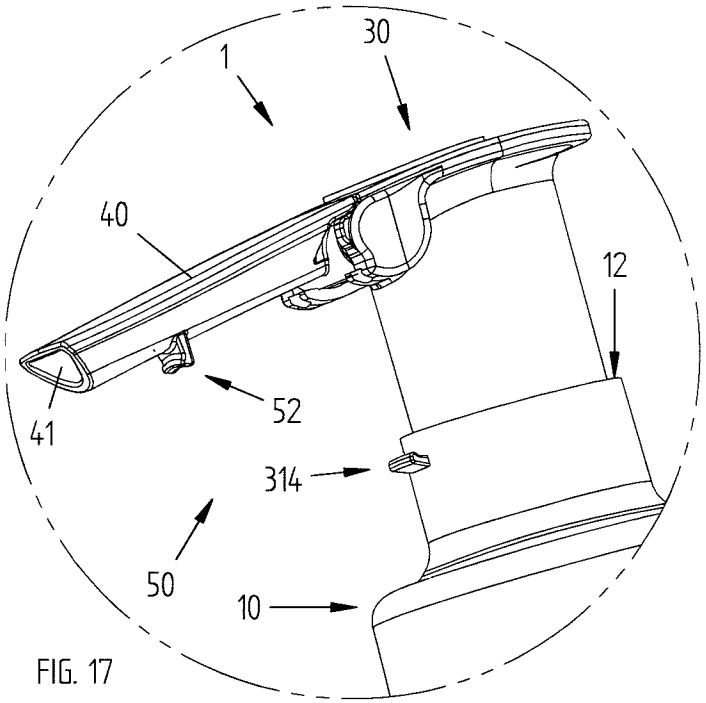
FIG. 17 shows a variant embodiment of FIG. 10.

FIGS. 17, 18 and 18A show a preferred variant embodiment of the invention, which differs from the embodiment previously illustrated above and described with reference to Figures from 1 to 12A in that the second counteracting element 314 comprises an element that projects from the engagement portion 10.

When the dispensing nozzle 40 is arranged in the non-dispensing position, the projecting element 52 of the dispensing nozzle 40 abuts against and on the projecting element 314 of the engagement portion 10, as shown in the detail of FIG. 18A.

The mutual position of the projecting elements 52, 314 prevents any movement of the operating cap 30 with respect to the engagement portion 10 in the case where the operating cap 30 is pressed along the pressing direction P.

Advantageously, if the operating cap 30 is pressed, on purpose or inadvertently, along the pressing direction P when the dispensing nozzle 40 is in its non-dispensing position, undesired outflows if fluid or liquid from the container C are avoided.

The projecting element 314 of the engagement portion 10 preferably comprises also a reference portion 354 which protrudes from the projecting element 314 in the direction of the projecting element 52 of the dispensing nozzle 40.

The reference portions 54, 354 of the respective projecting elements 52, 314 allow the mutual snap-on connection of the projecting elements 52, 314.

The snap-on connection of the projecting elements 52, 314 is preferably obtained thanks to the elasticity of the projecting elements 52, 314, such elasticity being due to the material with which the projecting elements 52, 314 are made. Preferably, also the projecting element 314 of the engagement portion 10 is made of a plastic material. The projecting element 314 and the engagement portion 10 are preferably obtained in a single piece, for example through a thermoplastic moulding process.

This solution makes it possible to achieve all the advantages mentioned with reference to the previous embodiments.

Figure 20:
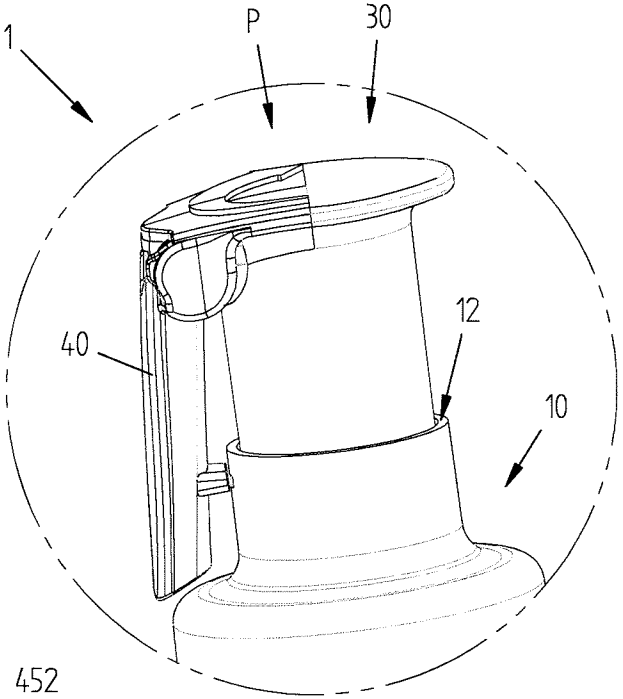
FIG. 20 shows the detail of the system of FIG. 19 with the dispensing nozzle in a non-dispensing position.
Figure 20A:
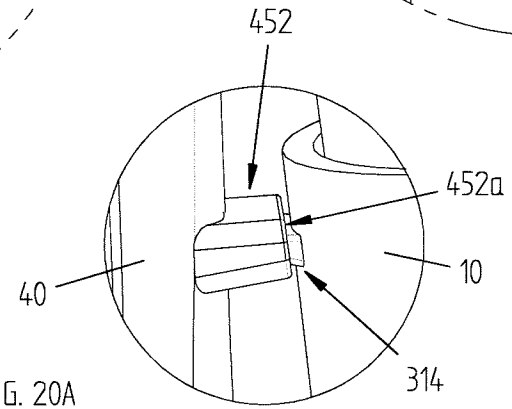
FIG. 20A shows an enlarged detail of FIG. 20.
Figure 19:
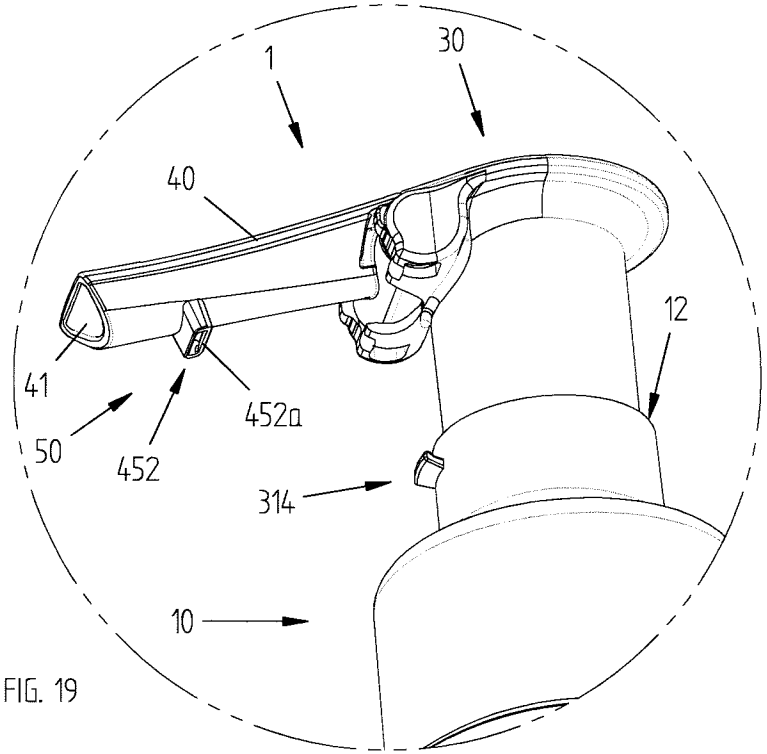
FIG. 19 shows a variant embodiment of FIG. 10.

FIGS. 19, 20 and 20A show a preferred variant embodiment of the invention, which differs from the embodiment previously illustrated above and described with reference to FIGS. 17, 18 and 18A in that the first counteracting element 452 comprises a seat which is associated with the dispensing nozzle 40.

The seat 452 preferably comprises a slot 452*a* defined in a projection that protrudes from the dispensing nozzle 40 in the direction of the projecting element 314 of the engagement portion 10.

When the dispensing nozzle 40 is in the non-dispensing position, the projecting element 314 of the engagement portion 10 fits, preferably snaps into the seat 452 that defines the first counteracting element, more particularly in the slot 452*a*, as shown in the detail of FIG. 20A.

The mutual position of the projecting element 314 inside the seat 452 prevents any movement of the operating cap 30 with respect to the engagement portion 10 in the case where the operating cap 30 is pressed along the pressing direction P.

Advantageously, if the operating cap 30 is pressed, on purpose or inadvertently, along the pressing direction P when the dispensing nozzle 40 is in its non-dispensing position, undesired outflows of fluid or liquid from the container C are avoided.

This solution makes it possible to achieve all the advantages mentioned with reference to the previous embodiments.

It has thus been shown, by means of the preceding detailed description of the embodiments of the present invention illustrated in the drawings, that the present invention makes it possible to achieve all the set objects and to overcome the drawbacks posed by the dispensing devices made according to the known art. The present invention, in fact, makes it possible to eliminate or at least minimize the risk of liquid or fluid leakages when the nozzle is in its non-dispensing position.

In particular, it has been shown that the objects of the invention can be achieved through the constraining means comprising a first counteracting element associated with the dispensing nozzle and a second counteracting element associated with the engagement portion.

The first counteracting element and/or the second counteracting element preferably comprise a projecting element and/or a seat which are suited to interact in order to prevent any movement of the main operating body with respect to the engagement portion along the pressing direction when the dispensing nozzle is in the non-dispensing position.

While the present invention has been described with reference to the specific embodiments represented in the drawings, it should be pointed out that the present invention is not limited to the particular embodiments illustrated and described; on the contrary, further variants of the embodiments described herein fall within the scope of the present invention, which is defined in the claims.

The invention claimed is:

1. A dispensing device (1) suited to dispense a liquid or a fluid held in a container (C), said device (1) comprising an engagement portion (10) for the mutual engagement of said device (1) and said container (C), drawing and dispensing means (20) suited to draw said fluid or liquid from said container (C) and to respectively dispense it, a main operating body (30) suited to operate said device (1) through pressure exerted along a pressing direction (P) of said drawing and dispensing means (20), said main operating body (30) being suited to be moved axially with respect to said engagement portion (10), when subjected to said pressure, between a rest position and an activating position for the operation of said drawing and dispensing means (20), a dispensing nozzle (40) fixed to said main operating body (30) and provided with a dispensing duct (41) for dispensing said fluid or liquid, wherein said dispensing nozzle (40) is switched with respect to said main operating body (30), through a rotary movement, between a dispensing position, in which said dispensing duct (41) is in communication with the inside of said main operating body (30), and a non-dispensing position, and constraining means (50) suited to prevent the movement of said main operating body (30) along said pressing direction (P) with respect to said engagement portion (10) when said dispensing nozzle (40) is in the non-dispensing position, wherein said constraining means (50) comprise a first counteracting element (52; 152; 452) associated with said dispensing nozzle (40) and a second counteracting element (14; 314) associated with said engagement portion (10), said first counteracting element (52; 152) comprises a tab that protrudes from said dispensing nozzle (40), and said main operating body (30) is configured to slide inside said engagement portion (10); and wherein, when the dispensing nozzle is in the non-dispensing position, the first counteracting element is received within a cavity defined by an upper edge of the engagement portion that remains fixed to the container and a housing seat in the main operating body that moves in concert with the main operating body so as to prevent axial movement of the main operating body.

2. The device (1) according to claim 1, wherein said second counteracting element (314) comprises a projecting element associated with said engagement portion (10) or a housing seat associated with said engagement portion (10) or a counteracting portion (14) of an edge (12) of said engagement portion (10).

3. The device (1) according to claim 1, further comprising snap-on connection means suited to provide a snap-on connection between said first counteracting element (52; 152; 452) and said second counteracting element (14; 314).

4. The device (1) according to claim 3, wherein at least one of said first and second counteracting elements is at least partially elastic.

5. The device (1) according to claim 2, wherein said tab of said first counteracting element (52; 152) or said projecting element of said second counteracting element (314) comprises a reference portion (54; 354) that protrudes from said tab suited to become engaged in a surface of said second counteracting element or of said first counteracting element when said dispensing nozzle (40) is in said non-dispensing position.

6. The device (1) according to claim 1, wherein said main operating body (30) comprises an operating cover and said engagement portion (10) comprises a threaded metal ring suited to receive said operating cover, said operating cover being suited to slide with respect to said threaded metal ring, preferably to slide inside said threaded metal ring, between said rest position and said activating position and vice versa.

7. The device (1) according to claim 1, further comprising elastic return means (25) suited to bring said main operating body (30) back to said rest position from said activating position.

8. A system for dispensing a fluid or a liquid, said system comprising a container (C) suited to hold said fluid or liquid, wherein said system furthermore comprises a device (1) according to claim 1.

* * * * *